US011145946B2

(12) United States Patent
Zhang et al.

(10) Patent No.: US 11,145,946 B2
(45) Date of Patent: Oct. 12, 2021

(54) LOW FREQUENCY AND DIRECT CURRENT SIGNAL BLOCKING DEVICE AND ANTENNA

(71) Applicant: CommScope Technologies LLC, Hickory, NC (US)

(72) Inventors: Xun Zhang, Suzhou (CN); Xiaotuo Wang, Suzhou (CN); Bo Wu, Suzhou (CN); Ligang Wu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 83 days.

(21) Appl. No.: 16/583,499

(22) Filed: Sep. 26, 2019

(65) Prior Publication Data

US 2020/0136222 A1 Apr. 30, 2020

(30) Foreign Application Priority Data

Oct. 29, 2018 (CN) ..... 201811263937.2

(51) Int. Cl.

| | |
|---|---|
| ***H01P 1/203*** | (2006.01) |
| ***H01P 3/08*** | (2006.01) |
| ***H01Q 15/14*** | (2006.01) |
| ***H01P 1/20*** | (2006.01) |
| ***H01Q 1/50*** | (2006.01) |

(52) U.S. Cl.

CPC ..... *H01P 1/203* (2013.01); *H01P 1/2007* (2013.01); *H01P 3/08* (2013.01); *H01Q 1/50* (2013.01); *H01Q 15/14* (2013.01)

(58) Field of Classification Search

CPC ..... H01P 1/203; H01P 3/08; H01P 1/2007; H01P 1/20345; H01Q 1/526; H01Q 1/50; H01Q 15/14; H01Q 15/248; H01Q 19/195; H01Q 5/357; H01Q 5/364; H01Q 5/371; H05K 1/0253; H05K 2201/0969

See application file for complete search history.

(56) References Cited

U.S. PATENT DOCUMENTS

| | | | | |
|---|---|---|---|---|
| 3,946,339 A * | 3/1976 | Oltman, Jr. | ..... | H01P 5/20 333/121 |
| 4,644,302 A * | 2/1987 | Harris | ..... | H01P 5/12 333/125 |
| 5,539,360 A * | 7/1996 | Vannatta | ..... | H01P 3/00 333/4 |
| 9,590,284 B1 * | 3/2017 | Nordquist | ..... | H01P 1/203 |

(Continued)

*Primary Examiner* — Dimary S Lopez Cruz
*Assistant Examiner* — Yonchan J Kim
(74) *Attorney, Agent, or Firm* — Myers Bigel, P.A.

(57) ABSTRACT

A low frequency and direct current (DC) signal blocking device includes a dielectric substrate layer; a low frequency and DC signal blocking transmission line on a first surface of the substrate layer, where the low frequency and DC signal blocking transmission line has an input end and an output end; a metal layer on a second surface of the substrate layer, where there is at least one gap on the metal layer such that the metal layer is separated into at least a first sub-region and a second sub-region, where the gap is configured to block at least one of a low frequency signal and a DC signal; the substrate layer disposed between the low frequency and DC signal blocking transmission line and the metal layer; and a metal plate, wherein a dielectric layer is disposed between the metal plate and the metal layer.

19 Claims, 4 Drawing Sheets

(56) References Cited

U.S. PATENT DOCUMENTS

| | | | | |
|---|---|---|---|---|
| 2006/0071739 | A1* | 4/2006 | Hsu | H01P 3/081 333/238 |
| 2007/0235213 | A1* | 10/2007 | Lee | H05K 1/0218 174/255 |
| 2009/0302977 | A1* | 12/2009 | Lindmark | H01P 3/02 333/238 |
| 2010/0188281 | A1* | 7/2010 | Hayata | H01P 1/2007 342/118 |
| 2012/0194290 | A1* | 8/2012 | Wu | H01P 3/026 333/12 |
| 2018/0083334 | A1* | 3/2018 | Petrovic | H01P 5/085 |
| 2018/0166776 | A1* | 6/2018 | Ziegler | H01Q 1/362 |
| 2018/0323485 | A1* | 11/2018 | Gnanou | H01P 1/20345 |
| 2019/0221529 | A1* | 7/2019 | Yong | H01L 23/552 |

* cited by examiner

LOW FREQUENCY AND DIRECT CURRENT SIGNAL BLOCKING DEVICE AND ANTENNA

CROSS-REFERENCE TO RELATED APPLICATION

The present application claims priority to Chinese Patent Application Serial No. 201811263937.2, filed Oct. 29, 2018, the entire content of which is incorporated herein by reference.

FIELD

The present invention relates to blocking devices for low frequency and direct current ("DC") signals for antennas, and to antennas having such low frequency and DC signal blocking devices.

BACKGROUND

In antenna systems such as antenna systems for cellular communications systems, various signals such as RF signals, low frequency control signals and/or DC signals may be transmitted on the same transmission line. The RF signals typically are the signals transmitted and received by the antenna system. The low frequency signals typically are control signals, such as, for example, control signals for a remote electronic downtilt (RET) device. The DC signals may be power signals that are used to power components within the antenna.

In order to separate the RF signals from the low frequency signals and/or the DC signals, it may be necessary to provide a low frequency signal blocking device on a transmission line path to block the low frequency signals. Such a low frequency signal blocking device will also block DC signals. The current practice is to add a coupling layer to a transmission line that is implemented on a printed circuit board (PCB) to achieve a capacitive-coupling and accordingly low frequency and DC signal suppression. However, these methods may be complicated, and also may have high costs.

SUMMARY

The present invention provides a low frequency and DC signal blocking device, characterized in that the low frequency and DC signal blocking device comprises: a dielectric substrate layer; a low frequency and DC signal blocking transmission line on a first surface of the substrate layer, wherein the low frequency and DC signal blocking transmission line has an input end and an output end; a metal layer on a second surface of the substrate layer, wherein there is at least one gap on the metal layer such that the metal layer is separated into at least a first sub-region and a second sub-region, wherein the gap is configured to block at least one of a low frequency signal and a DC signal; the substrate layer disposed between the low frequency and DC signal blocking transmission line and the metal layer; and a metal plate, wherein a dielectric layer is disposed between the metal plate and the metal layer.

According to the present invention, the DC signal blocking device requires less wiring space, has a simple structure, is easy to operate, and has reduced cost.

In some embodiments, the dielectric layer includes a solder mask layer and/or air.

In some embodiments, the input end is configured to be connected to a first cable upstream of the low frequency and DC signal blocking device, and the output end is configured to be connected to a second cable downstream of the low frequency and DC signal blocking device.

In some embodiments, the first and second cables are coaxial cables.

In some embodiments, the input end is connected to an inner conductor of the first cable, and the output end is connected to an inner conductor of the second cable.

In some embodiments, the first sub-region is connected to an outer conductor of the first cable, and the second sub-region is connected to an outer conductor of the second cable.

In some embodiments, the metal plate is a reflector of an antenna.

In some embodiments, the metal plate is connected to the metal layer only via the solder mask layer.

In some embodiments, the metal layer has two or more gaps such that the metal layer is divided into a first sub-region, a second sub-region, and one or more additional regions, the first sub-region being spaced apart from the second sub-region by the one or more additional regions.

In some embodiments, the low frequency and DC signal blocking transmission line is configured in a straight line shape or an L shape.

In some embodiments, the low frequency and DC signal blocking transmission line is configured in a T-shape, wherein the low frequency and DC signal blocking transmission line has one input end and two output ends.

In some embodiments, the low frequency and DC signal blocking transmission line is configured in a cross shape, wherein the low frequency and DC signal blocking transmission line has one input end and three output ends.

In some embodiments, the metal layer is a copper layer.

In some embodiments, the second sub-region is configured as a polygonal region or a region with a circular arc.

In some embodiments, the second sub-region is configured as a rectangular region, a triangular region, a hexagonal region or an octagonal region.

In some embodiments, the gap is filled with air.

In some embodiments, the gap is completely or partially filled with solid dielectric materials. For example, ceramic, glass, mica sheets, bakelite or the like may be completely or partially filled in the gap to change the dielectric constant of the gap.

In some embodiments, the substrate layer is configured as a paper substrate, a glass fiber substrate, or a composite substrate. Of course, other types of substrates such as a paper substrate (FR-1, FR-2), a composite substrate (CEM series), or a substrate of special materials (ceramic, metal base, etc.) may also be used for the substrate layer of the PCB.

In some embodiments, the area of the second sub-region, the thickness of the metal layer and/or the width of the gap are adapted to a frequency range of the radio frequency signals.

In some embodiments, the thickness of the metal layer is between 0.02 mm and 0.3 mm.

In some embodiments, the width of the gap is between 0.01 mm and 1 mm.

The present invention also provides a DC-blocking antenna having at least one low frequency and DC signal blocking device according to the present invention.

DETAILED DESCRIPTION

Figure 1:
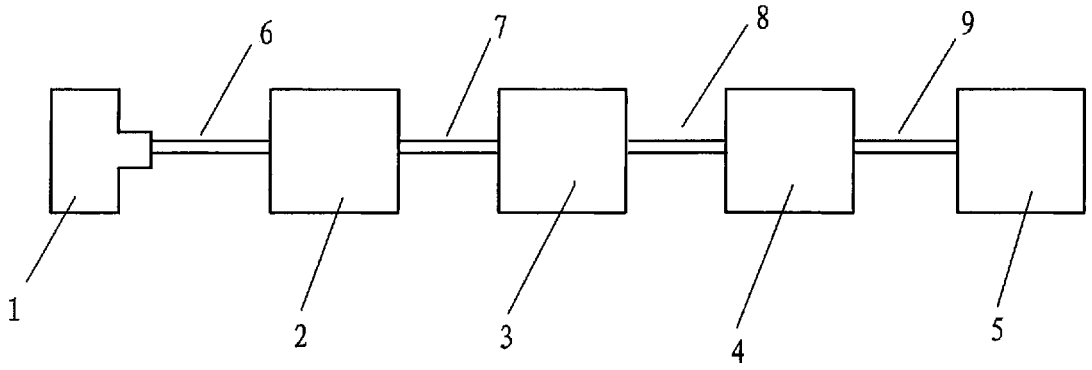
FIG. 1 is a partial schematic view of an antenna system that includes a low frequency and DC signal blocking device.

Embodiments of the present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the protection scope of the present invention to a person skilled in the art. It should also be understood that, the embodiments disclosed herein can be combined in various ways to provide many additional embodiments.

It should be understood that, the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the listed items.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

It should be understood that, in all the drawings, the same reference signs present the same elements. In the drawings, for the sake of clarity, the sizes of certain features may be modified.

In antenna systems, various signals such as RF signals, low frequency control signals and/or DC power signals may be transmitted on the same transmission line. The RF signals may be signals that are transmitted or received by the antenna system, and can include signals in multiple different RF frequency bands. The low frequency signals typically are control signals such as signals that control a RET device. The frequency range of the low frequency signals (such as Antenna Interface Signal Group signals) may be between 1 MHz to 5 MHz. In other embodiments, the frequency range of the low frequency signals may be smaller than 1 MHz or larger than 5 MHz. The DC signals are typically DC power signals that power electronic and/or electromechanical elements within the antenna. Since the RF signals and the low frequency and/or DC signals have different functions, it is necessary to process them separately.

Referring now to FIG. 1, a partial schematic view of an antenna system with a low frequency and DC signal blocking device is shown. As shown in FIG. 1, the antenna system includes an antenna port 1, a first processing circuit 2, a low frequency and DC signal blocking device 3, a second processing circuit 4, and a radiation unit 5. The antenna port 1 transmits a signal to the first processing circuit 2 via a first cable 6. The first processing circuit 2 may, for example, be a phase shifter circuit, which is controlled via control commands generated, for example, by a RET device (not shown). It is possible that an RF signal and a low frequency and/or DC signal may, for example, be transmitted on the second cable 7 at the same time. In order to separate the low frequency and/or DC signals from the RF signal, the first processing circuit 2 transmits the composite signal to the low frequency and DC signal blocking device 3 via a second cable 7. In the low frequency and DC signal blocking device 3, low frequency and/or DC signals are filtered away or suppressed. Thus, the low frequency and DC signal blocking device 3 blocks the low frequency and/or DC signals and transmits the RF signal to the second processing circuit 4 via a third cable 8. The second processing circuit 4 may be, for example, a filter circuit such as a frequency-band-division filter. Then, the second processing circuit 4 further transmits the RF signal to the radiation unit 5 via a fourth cable 9.

Figure 2:
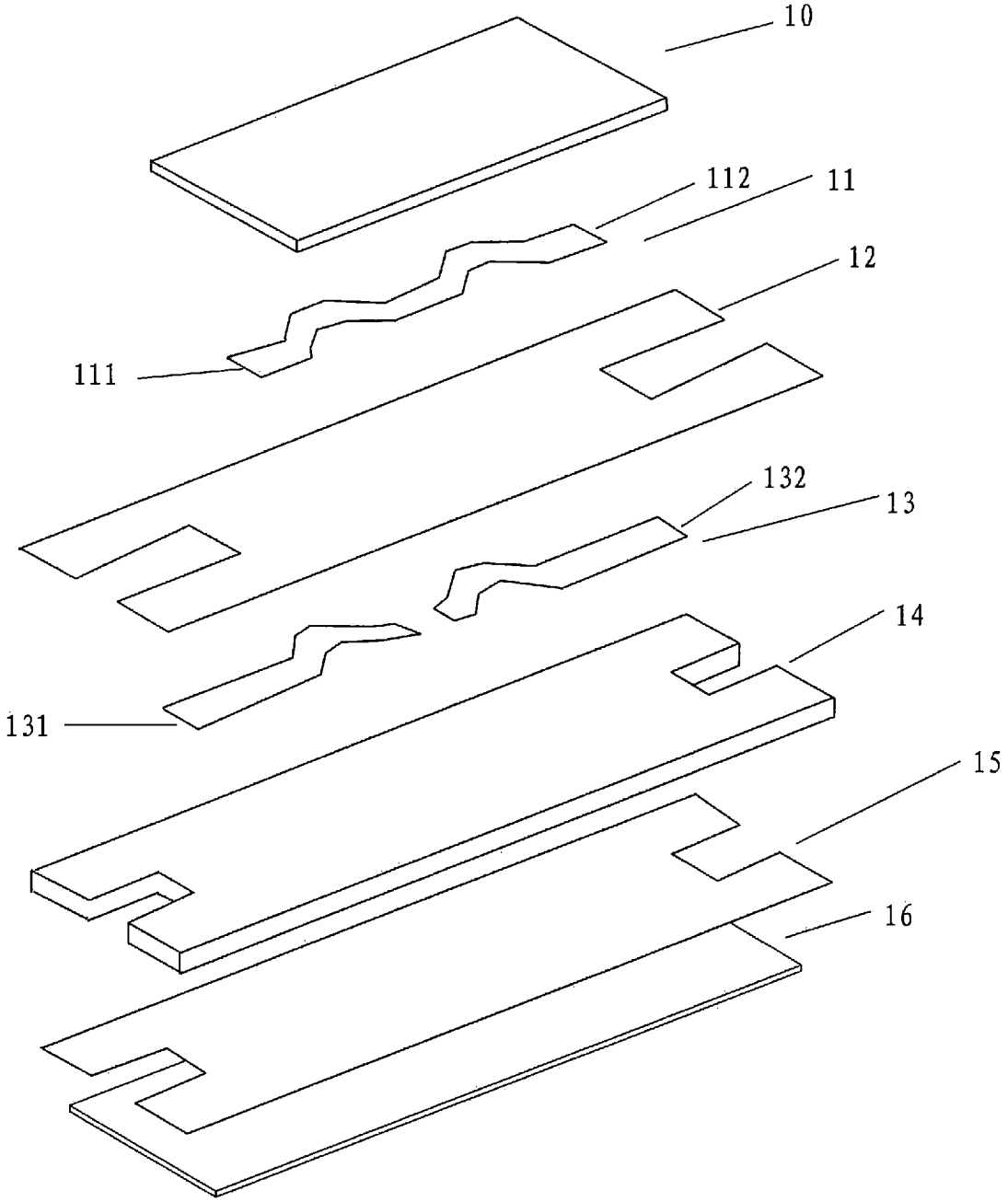
FIG. 2 is a schematic view of a conventional low frequency and DC signal blocking device.

Referring now to FIG. 2, an exploded schematic view of a conventional low frequency and DC signal blocking device is shown. As shown in FIG. 2, the low frequency and DC signal blocking device is constructed on a multilayer PCB. The low frequency and DC signal blocking device comprises a first substrate layer 10, a coupling transmission line 11, a solder mask layer 12, a low frequency and DC signal blocking transmission line 13, a second substrate layer 14, a copper layer 15, and a metal plate 16. The coupling transmission line 11 is disposed below the first substrate layer 10 and above the solder mask layer 12. The low frequency and DC signal blocking transmission line 13 is disposed above the second substrate layer 14 and below the solder mask layer 12. The metal plate 16 may be, for example, a reflector of an antenna.

Placing the low frequency and DC signal blocking device in FIG. 2 in the antenna system described in FIG. 1, an inner conductor of the second cable 7 is connected, for example, to the low frequency and DC signal blocking transmission line 13, and an outer conductor of the second cable 7 is connected, for example, to the copper layer 15. In order to block low frequency and DC signals, as can be seen from FIG. 2, the low frequency and DC signal blocking transmission line 13 includes a gap, so that low frequency and DC signals cannot be transmitted from an input end 131 to an output end 132 of the low frequency and DC signal blocking transmission line 13. Further, as the gap in the low frequency and DC signal blocking transmission line 13 has a small coupling capacitance between an input end 131 and an output end 132 thereof, the coupling transmission line 11 is provided in order to smoothly transmit RF signals. Thus, the RF signals can be coupled from the input end 131 of the low frequency and DC signal blocking transmission line 13 to the input end 111 of the coupling transmission line 11 via the solder mask layer 12, and then coupled from the output end 112 of the coupling transmission line 11 to the output end 132 of the low frequency and DC signal blocking transmission line 13 via the solder mask layer 12. It can be seen that this low frequency and DC signal blocking device involves a multilayer PCB, and thus is complicated in structure and high in cost.

Figure 3:
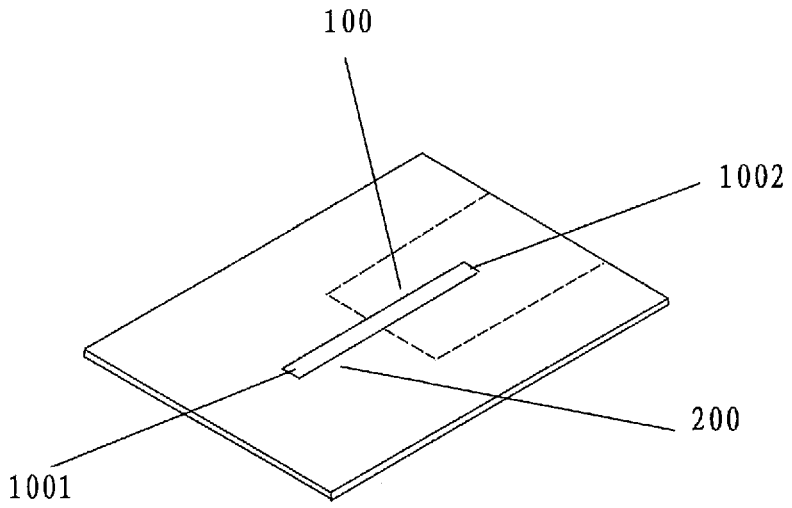
FIG. 3 is a schematic view of a low frequency and DC signal blocking device according to a first embodiment of the present invention.
Figure 4:
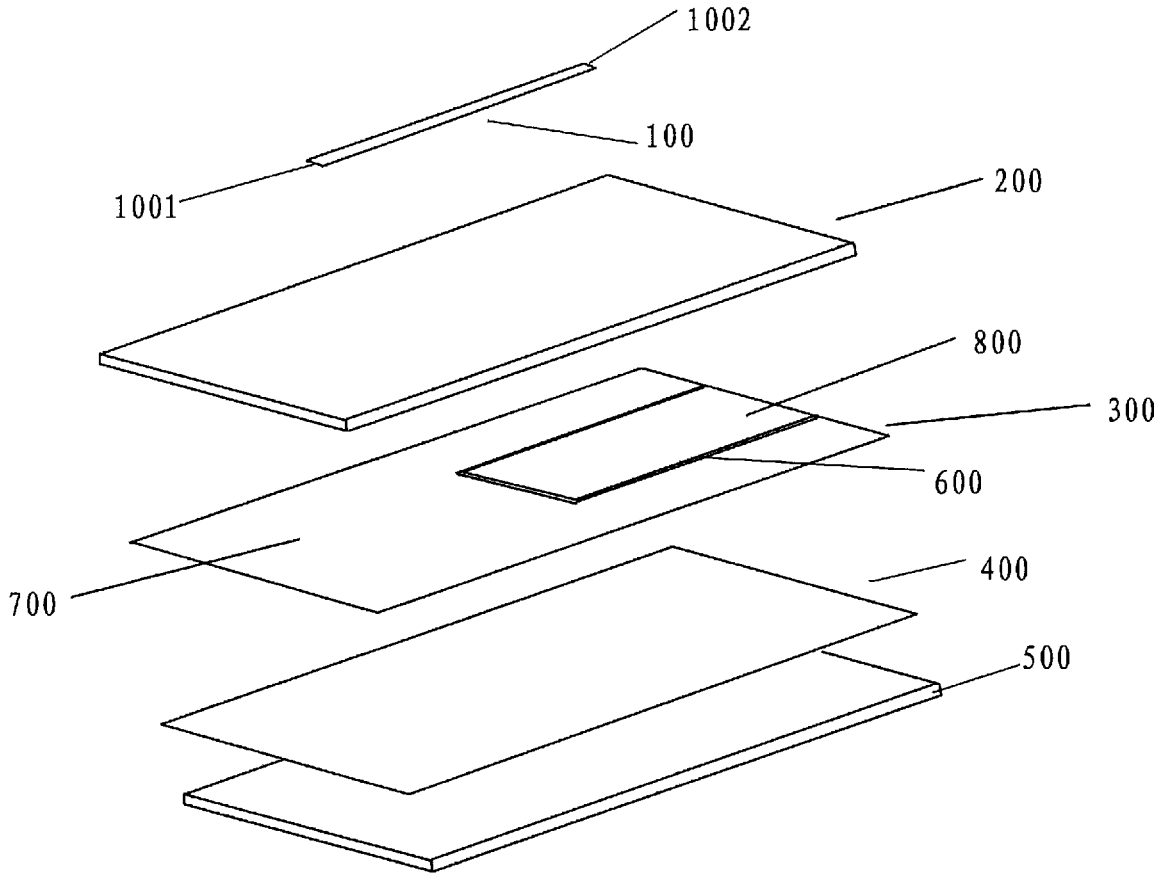
FIG. 4 is an exploded schematic view of the low frequency and DC signal blocking device of FIG. 3.

Referring now to FIGS. 3 and 4, a schematic view and an exploded schematic view of a low frequency and DC signal blocking device according to embodiments of the present invention are shown. As can be seen from FIGS. 3 and 4, the low frequency and DC signal blocking device is constructed on a PCB. The low frequency and DC signal blocking device comprises a low frequency and DC signal blocking transmission line 100, a substrate layer 200, a copper layer 300, a solder mask layer 400 and a metal plate 500. The low frequency and DC signal blocking transmission line 100 is disposed above the substrate layer 200, the copper layer 300 is disposed below the substrate layer 200, and the solder mask layer 400 is disposed below the copper layer 300. That is, the substrate layer 200 serves as a dielectric layer between the low frequency and DC signal blocking transmission line 100 and the copper layer 300. The dielectric layer may be, for example, a paper substrate, a glass fiber substrate or a composite substrate. In the present example, the metal plate 500 may be a reflector of an antenna.

As can be seen from FIGS. 3 and 4, the low frequency and DC signal blocking transmission line 100 has an input end 1001 and an output end 1002. The input end 1001 directs signals from the second cable 7 to the low frequency and DC signal blocking transmission line 100. The output end 1002 transmits the signals to a subsequent circuit, such as the second processing circuit 4 and the radiation element 5 in FIG. 1.

Further, it can be seen that the copper layer 300 has a gap 600 therein, which divides the copper layer 300 into a first sub-region 700 and a second sub-region 800 that is surrounded by the first sub-region. The second sub-region 800 is located at the edge of the copper layer 300 and is configured to be rectangular. The second sub-region 800 and the first sub-region 700 are spaced apart from one another by the gap 600, thereby forming a capacitor. Further, the first sub-region 700 and the second sub-region 800 may be spaced apart from the metal plate 500 by the solder mask layer 400. The first sub-region 700 and the second sub-region 800 may be separated from the metal plate 500 via only the solder mask layer 400, thereby forming capacitors with the metal plate 500. Thus, the coupling between the copper layer 300 and the metal plate 500 may be improved in a simple manner. In other embodiments, it is also possible that the first sub-region 700 and the second sub-region 800 are spaced apart from the metal plate 500 by the solder mask layer 400 and/or air. This multi-coupling design is advantageous in that it can maintain good RF-passing performance and low frequency and DC signal blocking function in a limited space.

In the present embodiment, the first sub-region 700 and the second sub-region 800 form the two electrodes of a capacitor, and the gap 600 acts as the dielectric of the capacitor. The three edges of the metal layer that forms the second sub-region 800 that are adjacent the gap 600 are equivalent to the effective overlap area of the capacitor, and the width of the gap 600 is equivalent to the distance between the two electrodes of the capacitor. In order to adjust the capacitance of the capacitor, a thickness of the copper layer 300 may be increased or decreased, and alternatively, an area of the second sub-region 800 may be increased/decreased to thereby increase/decrease the effective overlap area. In addition, a solid dielectric material may also be filled or partially filled in the gap 600.

Similarly, the first sub-region 700 and the metal plate 500, as well as the second sub-region 800 and the metal plate 500 form the electrodes of respective second capacitors. Thus, in order to adjust the size of the second capacitors, an area of the first sub-region 700 and the second sub-region 800 may be increased/decreased so as to increase/decrease the effective overlap area. In addition, solid dielectric materials may also be filled or partially filled between the first sub-region 700 and the metal plate 500 and/or between the second sub-region 800 and the metal plate 500.

In this embodiment, the thickness of the copper layer 300 may be between 0.02 mm and 0.3 mm. Of course, it may also be less than 0.02 mm or more than 0.3 mm in other embodiments, and the thickness of the copper layer 302 may be selected according to the characteristics of the RF signals and processing technology. Also, in this embodiment, the width of the gap 600 is between 0.02 mm and 0.1 mm. Of course, it may also be less than 0.02 mm or more than 0.1 mm in other embodiments, and the width of the gap 600 may be selected according to the characteristics of the RF signals and processing technology.

In order to achieve the function of blocking low frequency and DC signals, the first cable 6 upstream of the low frequency and DC signal blocking device 3 may be connected to the input end 1001 of the low frequency and DC signal blocking transmission line 100. The output end 1002 of the low frequency and DC signal blocking transmission line 100 may be connected to the second cable 7 downstream of the low frequency signal blocking device 3. Specifically, the inner conductor of the first cable 6 may be connected to the input end 1001, and the outer conductor of the first cable 6 may be connected to the first sub-region 700. The output end 1002 may be connected to the inner conductor of the second cable 7, and the outer conductor of the second cable 7 may be connected to the second sub-region 800, thereby breaking a transmission path of the low frequency and DC signals.

Thus, in the low frequency and DC signal blocking device according to embodiments of the present invention, the RF signals can pass from the first sub-region 700 through the gap 600 to the second sub-region 800 on the copper layer 300. At the same time, the RF signals can also pass from the first sub-region 700 to the metal plate 600 via the solder mask layer and/or air, and then from the metal plate 600 to the second sub-region 800 via the solder mask layer and/or air. Thus, the RF signals can reach the output end 1002 from the input end 1001 on the low frequency and DC signal blocking transmission line 100.

In contrast, the low frequency and DC signals are unable to pass through the gap 600 in the copper layer 300. As a result, the low frequency and DC signals are unable to be transmitted from the input end 1001 to the output end 1002 of the low frequency and DC signal blocking transmission line 100.

The low frequency and DC signal blocking devices according to embodiments of the present invention may have a number of advantages. First, the low frequency and DC signal blocking device may require less wiring space. Second, the low frequency and DC signal blocking device has a wider bandwidth, since its characteristics is not designed for a specific frequency point. In addition, the low frequency and DC signal blocking device has simple structure, is easy to operate, and has controllable costs. Furthermore, the low frequency and DC signal blocking device according to embodiments of the present invention adopts a multi-coupling design, thereby maintaining good RF-passing performance and low frequency and DC signal-blocking function in a limited space.

In other embodiments, the second sub-region may be configured as a polygonal region or a region with a circular arc. For example, the second sub-region may be configured as a triangular region, a hexagonal region or an octagonal region.

In other embodiments, more gaps may be provided to divide the copper layer into more sub-regions. For example, other sub-regions may also be provided between the second sub-region and the first sub-region.

Figure 5A:
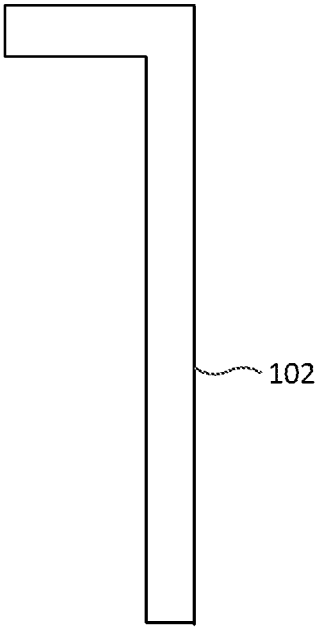
FIGS. 5A and 5B are schematic views of low frequency and DC signal blocking devices according to further embodiments of the present invention.
Figure 5B:
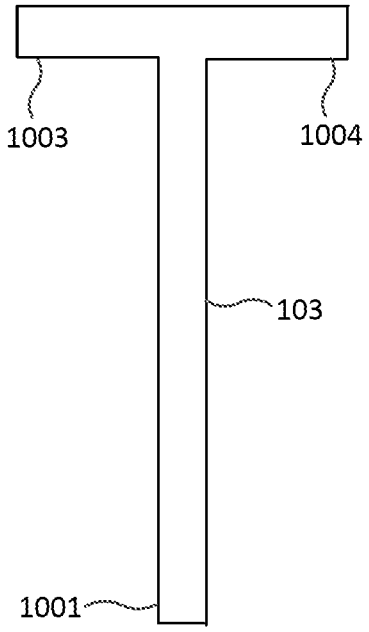

In other embodiments, the low frequency and DC signal blocking transmission line may be configured arbitrarily, for example, it may be configured in an L shape, a T shape, or a cross shape. For example, FIGS. 5A and 5B illustrate low frequency and DC signal blocking transmission lines 102, 103 having an L shape and a T shape, respectively. The low frequency and DC signal blocking transmission line 103 includes one input 1001 and two outputs 1003, 1004.

In other embodiments, the low frequency and DC signal blocking transmission line may have multiple input ends and multiple output ends. For example, a T-shaped low frequency and DC signal blocking transmission line may have one input end and two output ends. As such, a cross-shaped low frequency and DC signal blocking transmission line may have one input end and three output ends. Of course, a low frequency and DC signal blocking transmission line of any other form may also be envisaged.

Although the exemplary embodiments of the present invention have been described, a person skilled in the art should understand that, multiple changes and modifications may be made to the exemplary embodiments without substantively departing from the spirit and scope of the present invention. Accordingly, all the changes and modifications are encompassed within the protection scope of the present invention as defined by the claims. The present invention is defined by the appended claims, and the equivalents of these claims are also contained therein.

That which is claimed is:

1. A low frequency and direct current ("DC") signal blocking device, characterized in that the low frequency and DC signal blocking device comprises:

a dielectric substrate layer;

a low frequency and DC signal blocking transmission line on a first surface of the dielectric substrate layer, wherein the low frequency and DC signal blocking transmission line has an input end and an output end;

a metal layer on a second surface of the dielectric substrate layer, wherein the dielectric substrate layer is disposed between the low frequency and DC signal blocking transmission line and the metal layer, wherein there is at least one gap in the metal layer such that the metal layer is separated into at least a first sub-region and a second sub-region that is spaced apart from the first sub-region by the at least one gap, wherein the at least one gap is configured to block at least one of a low frequency signal and a DC signal and not block radio frequency ("RF") signals; and a metal plate, wherein a dielectric layer is disposed between the metal plate and the metal layer, wherein the first sub-region and the second sub-region form two electrodes of a first capacitor.

2. The low frequency and DC signal blocking device according to claim 1, wherein the dielectric layer includes a solder mask layer and/or air.

3. The low frequency and DC signal blocking device according to claim 1, wherein the input end is configured to be connected to a first cable upstream of the low frequency and DC signal blocking device, and the output end is configured to be connected to a second cable downstream of the low frequency and DC signal blocking device.

4. The low frequency and DC signal blocking device according to claim 3, wherein the input end is connected to an inner conductor of the first cable, and the output end is connected to an inner conductor of the second cable.

5. The low frequency and DC signal blocking device according to claim 3, wherein the first sub-region is connected to an outer conductor of the first cable, and the second sub-region is connected to an outer conductor of the second cable.

6. The low frequency and DC signal blocking device according to claim 1, wherein the metal plate is a reflector of an antenna.

7. The low frequency and DC signal blocking device according to claim 2, wherein the metal plate is connected to the metal layer only via the solder mask layer.

8. The low frequency and DC signal blocking device according to claim 1, wherein the low frequency and DC signal blocking transmission line is configured in a straight line shape or an L shape.

9. The low frequency and DC signal blocking device according to claim 1, wherein the low frequency and DC signal blocking transmission line is configured in a T-shape, wherein the low frequency and DC signal blocking transmission line has one input end and two output ends.

10. The low frequency and DC signal blocking device according to claim 1, wherein the at least one gap is completely or partially filled with solid dielectric materials.

11. The low frequency and DC signal blocking device according to claim 1, wherein the area of the second sub-region, the thickness of the metal layer and/or the width of the at least one gap are adapted to a frequency range of the radio frequency signals.

12. The low frequency and DC signal blocking device according to claim 11, wherein a thickness of the metal layer is between 0.02 mm and 0.3 mm and a width of the at least one gap is between 0.01 mm and 1 mm.

13. The low frequency and DC signal blocking device according to claim 1, wherein the at least one gap is configured to allow the RF signals to capacitively couple from the first sub-region to the second sub-region.

14. The low frequency and DC signal blocking device according to claim 13, wherein the first sub-region, the metal plate and the dielectric layer form a second capacitor and the second sub-region, the metal plate and the dielectric layer form a third capacitor, wherein the second and third capacitors are configured to allow the RF signals to capacitively couple from the first sub-region to the second sub-region.

15. A low frequency and direct current ("DC") signal blocking device, characterized in that the low frequency and DC signal blocking device comprises: a dielectric substrate layer; a low frequency and DC signal blocking transmission line on a first surface of the dielectric substrate layer, wherein the low frequency and DC signal blocking transmission line has an input end that is configured to be connected to a first cable and an output end that is configured to be connected to a second cable, the low frequency and DC signal blocking transmission line extending continuously from the input end to the output end; a metal layer on a second surface of the dielectric substrate layer, wherein the dielectric substrate layer is between the low frequency and DC signal blocking transmission line and the metal layer, wherein a gap in the metal layer divides the metal layer into at least a first sub-region and a second sub-region that is not connected to the first sub-region, wherein the first sub-region and the second sub-region form two electrodes of a first capacitor.

16. The low frequency and DC signal blocking device according to claim 15, further comprising a solder mask layer on the metal layer and a metal plate, where the solder mask layer is between the metal plate and the metal layer.

17. The low frequency and DC signal blocking device according to claim 16, wherein the gap is configured to allow radio frequency ("RF") signals to capacitively couple from the first sub-region to the second sub-region.

18. The low frequency and DC signal blocking device according to claim 17, wherein the first sub-region, the metal plate and the dielectric layer form a second capacitor and the second sub-region, the metal plate and the dielectric layer form a third capacitor, wherein the second and third capacitors are configured to allow the RF signals to capacitively couple from the first sub-region to the second sub-region.

19. The low frequency and DC signal blocking device according to claim 18, wherein the metal plate is a reflector of an antenna.

* * * * *